United States Patent [19]

Hepp

[11] 4,374,406

[45] Feb. 15, 1983

[54] LIGHTWEIGHT ATTACHMENT FOR SOLAR CELL ARRAY NEXT TO A FLUORESCENT TUBE

[76] Inventor: James Hepp, 5 Fairview La., Glen Cove, N.Y. 11542

[21] Appl. No.: 282,186

[22] Filed: Jul. 10, 1981

[51] Int. Cl.[3] ..... F21V 33/00; G09F 11/02

[52] U.S. Cl. ..... 362/253; 40/473; 136/244; 136/291; 362/457

[58] Field of Search ..... 362/253, 457; 136/244, 136/247, 291

[56] References Cited

U.S. PATENT DOCUMENTS

| | | | |
|---|---|---|---|
| 3,860,829 | 1/1975 | Fabbri | 307/66 |
| 4,227,327 | 10/1980 | Thompson | 40/473 |
| 4,281,208 | 7/1981 | Kuwano et al. | 136/249 |

*Primary Examiner*—Aaron Weisstuch
*Attorney, Agent, or Firm*—Abraham A. Saffitz

[57] ABSTRACT

A lightweight attachment for a solar cell array in combination with spacing means for spacing the array consisting of a plurality of solar cells on a support next to a fluorescent tube to provide thereby a power package which is fitted with conductors to connect the solar cells in series to a remote motor adapted for the rotation of a remote display. A holding means is provided for the support to hold it close to the tube, which holding means may be a magnetic tape. The holding means may be a flexible strap having a tooth portion at the sides of the strap, the tooth sides being adapted to holding the support in closely spaced relation with the plurality of solar cells directly below the fluorescent tube. Spacing means is provided to fix the spacing between the surface of the cells on the support and the tube. Since there is no tension from the conductors and no substantial weight to dislodge the fluorescent tube due to the cells or support, the power package overcomes the safety hazards of the prior art.

7 Claims, 7 Drawing Figures

LIGHTWEIGHT ATTACHMENT FOR SOLAR CELL ARRAY NEXT TO A FLUORESCENT TUBE

BACKGROUND OF THE INVENTION

The invention relates to a support for photoelectric batteries, in particular, solar cells in a panel or array whereby the support orients the solar cells in close proximity between ½" and 1" next to the underside of the ordinary fluorescent tube, the solar cell being of the type which responds to the fluorescent radiation.

The invention further relates to mechanical holding means or flexible strap means for attachment to a light assembly consisting of a fluorescent tube fitted with fragile end pins constituting the electrical connection for the tube, the solar cells provided with conductor means whereby the radiation from the fluorescent tube converted into electrical current by the solar cells is lead to a station where an electric motor is energized as part of a rotating display.

The invention further lies in the field of strap means which serve to hold and mount an array of solar cells in closely spaced relation to an elongated fluorescent light fixture whereby the light to the solar cell is converted into current, and the assembly, being lightweight, does not tend to dislodge the electrical connection of the fluorescent tube which consists of fragile pins at the end of the tube.

DESCRIPTION OF THE PRIOR ART

Thompson U.S. Pat. No. 4,227,327 granted Oct. 14, 1980, describes and claims a solar sign assembly in which the unit assembly comprises a base, a dc motor, interconnecting means and a sign member, electrical interconnection between the solar cell and dc motor, and means controlling the rotation of the sign member at a speed slower than the rotation of the motor shaft.

Mauer et al. U.S. Pat. No. 4,149,902 granted Apr. 17, 1979, discloses a plastic film adapted to concentrate energy in the blue part of the visible spectrum onto a solar cell to make the cell more responsive to the energy of a fluorescent light source.

Fletcher U.S. Pat. No. 4,167,033 granted Sept. 4, 1979, shows a special mounting means comprising spaced U-bolts, spaced L-shaped brace members and a plate, the spaced brace members being adjustable by means of nuts which fits the U-bolts and move them relative to the brace members whereby the adjustment can be made in two different directions, the vertical axis and the horizontal axis. This is the adjustment used commercially on the luminaire fixture made by General Electric Company.

Auerbach U.S. Pat. No. 3,836,766 granted Sept. 17, 1974, in FIG. 12 shows a base ring and a diffuser in a light fixture wherein the ring and the diffuser are held together by a magnet.

Helm U.S. Pat. No. 3,970,837 granted July 20, 1976, shows the attachment of a light assembly to a vehicle by a flexible elongated magnetic member.

Kovacik et al. U.S. Pat. No. 4,262,327 granted Apr. 14, 1981, discloses the advantages of fluorescent lighting but emphasizes the fragility of the pins which are mounted on opposite ends of the fluorescent tube and constitute a health and safety hazard if they are dislodged or are broken during the process of attachment of a heavy load.

I am further aware that the inventor of U.S. Pat. No. 4,262,327 has proposed to sell an assembly which is attached to a fluorescent tube, the assembly consisting of a motor, a solar cell, a gear reducer, electrical interconnections, the combination of units being bulky and quite heavy because of the weight of the motor and gear assembly.

Finally, I am aware of the Schwartz U.S. Pat. No. 3,618,173, granted Nov. 9, 1971, which describes and claims a bundling strap for an elongated strap portion with teeth at its edges.

OBJECTS OF THE INVENTION

The object of the invention is to provide a lightweight attachment for a solar cell array on a support provided with holding means to orient and space the array near a fluorescent tube, the plurality of cells being fitted with conductors to conduct the electrical current from the cells to a remote dc motor for a display which moves in accordance with the rotation of the motor shaft.

A further object of the invention is to provide an attachment for securement to the magnetic portion of a reflector which is used in conjunction with a fluorescent tube fitted with a pair of fragile pins at opposite ends thereof, the attachment comprising support means for the plurality of solar cells constituting the array and spacing means which position and orient the array of cells below the tube, preferably at a distance of less than 1" to thereby permit efficient conversion of the light rays from the fluorescent tube into electrical current.

A further object of the invention is to provide a simple and low cost power package for attachment to an elongated fluorescent light fixture.

Other and further objects will become apparent from the summary of the invention, drawings and the detailed description of the preferred embodiments.

SUMMARY OF THE INVENTION

The problem of modifying a fluorescent light fixture in order to take advantage of the improved lighting efficiency of the light fixture is distinctly different than the problem of modifying an incandescent bulb. In Kovacik, et al. U.S. Pat. No. 4,262,327, the advantages of a portable fluorescent tube assembly are pointed out at column 1, these being more light, less glare, less energy input and better concentration of light in the desired location. Contrast the difficulties mentioned by Kovacik, et al. with the difficulties encountered with an ordinary incandescent light. In the case of the fluorescent tube in the conventional socket, the electrical connection is provided by a pair of relatively fine, fragile pins extending from opposite ends of the tube and these pins constitute the electrical terminals. In contrast, the incandescent bulb provides a relatively large area of contact for electrical connection around its threaded base. See Kovacik, et al. U.S. Pat. No. 4,262,327, column 1, lines 1–38.

In the conventional fluorescent light fixture the heavy ballast is separately mounted at the corner of the fixture within metallic reflector means which surround the tube after it is installed within the bayonet socket. The conventional bayonet socket contains three holes at each end, the two holes being adapted for insertion of the pins and the third hole with its recessed trackway constituting the position which one of the pins will enter when the tube is rotated. Insertion of the tube requires insertion of the two pins in the proper holes, a rotation of about 90° to engage the electrical contact position and the fixture is then operative for electrically lighting the tube when the switch is placed into the "on" position.

The utilization of devices which are supported by the tube, particularly devices which when attached tend to rotate the tube, run the risk of disconnecting the pins. As pointed out in the Kovacik, et al. patent, column 1, lines 60–64, dislodgement of the pins interrupts the current through the pins to the tube, produces a high voltage arc and introduces a safety and health hazard.

The present invention overcomes the tendency of prior attachments which are connected to the fluorescent tube from rotating the tube and dislodging the pins and for this purpose the invention provides an attachment consisting of a rigid lightweight heat-resistant plastic support material, elongated since it serves to support a plurality of solar cells in an array, and a layer or a lamina of electroconductive material which serves as a ground for conductors connecting individual solar cells of the array in spaced relation below a fluorescent tube. Spacing means are provided which space the array of solar cells below the tube. In one embodiment, this spacing means consists of a wall which is at right angles to the base support and the height of the wall is relied upon to space the array immediately next to and below the tube.

In another embodiment the spacing means is a strap which fits into a slot provided in the base support at about the central portion thereof.

In order to hold the lightweight, rigid support made of heat-resistant plastic in the proper spaced relation, holding means is provided which in the case of the embodiment using the wall as a spacing means is a magnetic tape secured to this wall and spaced inside the fluorescent lighting fixture adjacent the side of the tube so that the wall is magnetically held to the ferromagnetic reflector alongside of the tube with the array of solar cells immediately below the tube.

In the embodiment of the invention in which the strap is used, the spacing means consists of arcuate cutout portions constituting end walls preferably made of the same plastic material as the support itself. In this case the arcuate contour of the end walls is adapted to fit around the bottom of the fluorescent tube to place the array of solar cells next to the bottom of the tube. Accordingly, whenever the tube is lit, the first and second embodiments held magnetically and mechanically, respectively, are placed in the same close relationship so that the rotation from the fluorescent tube is directed to the entire area of the solar cell. In both embodiments the solar cells are connected by conductor wires in series to each other, one of the two conductor wires being connected to the ground provided by the conductive layer immediately below the solar cells of the array and the other of the conductor wires being connected to the ground. These conductor wires lead to a dc motor and gear reducer attached to a display sign. The motor, gear reducer and sign being bulky and much heavier than the solar cell package just described are preferably suspended from the ceiling or from a separate support at a location which is away from and relatively remote from the solar cell package which is attached to the fluorescent tube.

The Mauer, et al. U.S. Pat. No. 4,149,902 describes a film which improves the electrical efficiency of a solar cell which is illuminated with fluorescent light as from a fluorescent tube. The three dyes mentioned in this patent are Rhodamine B, Coumarin 6 and Fluorescein. Any one of these can be used.

In the manner above described, a novel display package for solar cell electrical power input is provided wherein the power package is lightweight, easily attached to a standard fluorescent fixture and properly spaced from the bottom of the fluorescent tube to provide a kinetic or rotating display which operates as long as the fluorescent tube is lit.

DESCRIPTION OF THE PREFERRED EMBODIMENTS

Figure 1:
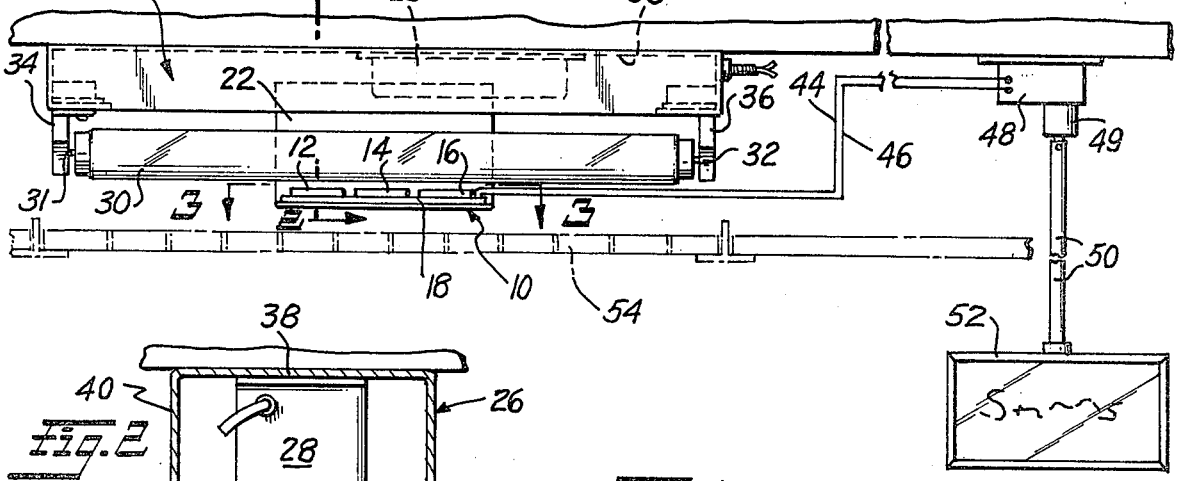
FIG. 1 is a fragmentary side elevational view which shows the relative placement of the solar cell package within a conventional fluorescent tube fixture fitted with a ballast and shows the conductor wires from the solar cell power package adapted for connection to a dc motor and gear box for slowly rotating a sign from light energy from the fluorescent tube impinging upon the solar cell array.
Figure 4:
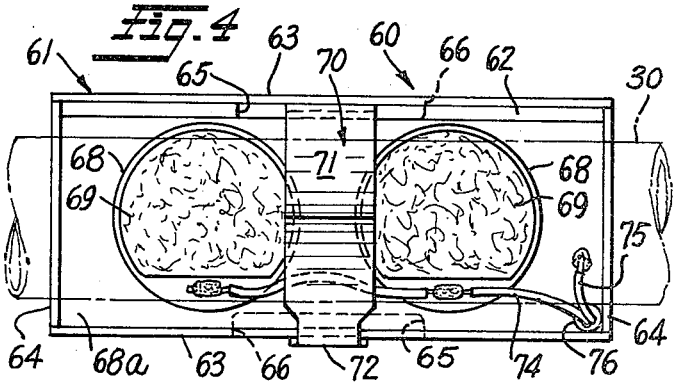
FIG. 4 is a plan view of a modification of the solar cell array attachment.
Figure 5:
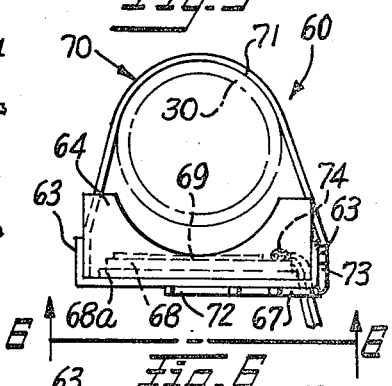
FIG. 5 is an end elevation view of the attachment of FIG. 4.
Figure 7:
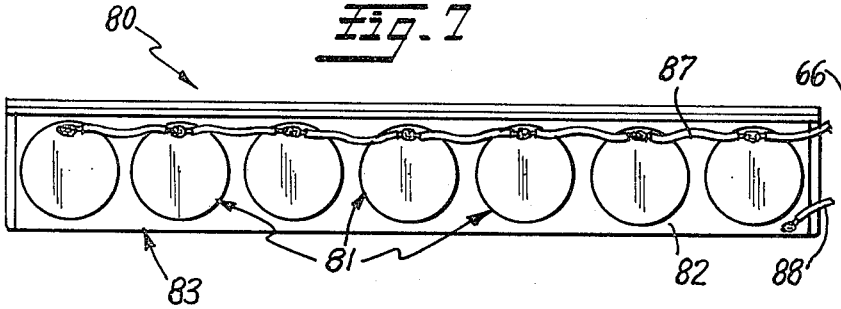
FIG. 7 is a further modification of the solar cell array.
Figure 6:
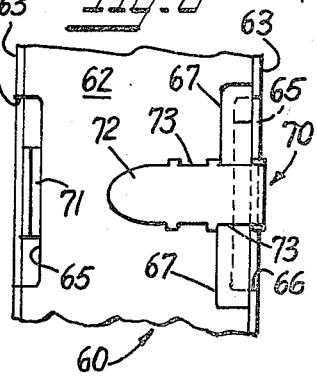
FIG. 6 is a fragmentary bottom plan view of the attachment of FIG. 4, taken on the line 6—6 thereof.

The solar cell power packages 10, 60 and 80 of the invention shown in FIGS. 1, 4 and 7 of the drawing comprise a horizontal support means at the bottom of the package consisting of a heat-resistant plastic on which a plurality of solar cells is connected in series by an electrical conductor may be brought into close proximity to a fluorescent tube 30, a spacing means such as vertical leg 22 which facilitates the spacing of the horizontal leg support 21 to the desired location with respect to the fluorescent tube, a holding means which may be mechanical such as adjustable strap 70 in FIG. 4, or magnetic, e.g., tape 24. The holding means for the solar cell power package in the case of the embodiment of FIGS. 1, 2 and 3 is a magnetic attachment means consisting of the magnetic tape 24 while the holding means in the case of the embodiment of FIGS. 4, 5 and 6 is a flexible adjustable strap which is insertable in a recess or opening 76 provided in the horizontal support means formed by the bottom wall 62 of the power package 60.

The power package 80 in FIG. 7 illustrates an embodiment of the solar cell array 81 in which the plate 82 constitutes the horizontal support means and the spacing means is formed by angular support 83. The number of solar cells in the array 81 is intended to illustrate a series connection of a large group of cells in close side-by-side relationship connected in series to each other by conductor 87 and the ground conductor 88 completes the circuit.

In order to bring the array of solar cells such as shown in FIG. 4 into as close a possible position in proximity to the bottom of the fluorescent tube 30, the end walls 64 are provided one at each end of the bottom wall 62. In this embodiment of FIG. 4 the end walls are provided with arcuate openings to accommodate the ends of the package 60 around the bottom curvature of the tube 30.

Figure 2:
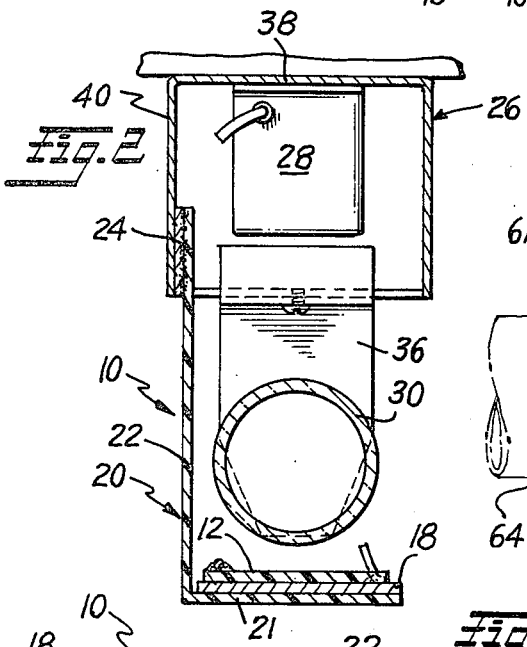
FIG. 2 is an enlarged transverse vertical sectional view through the solar cell power package along line 2—2 of FIG. 1 showing magnetic attachment means for the solar cell power package.
Figure 3:
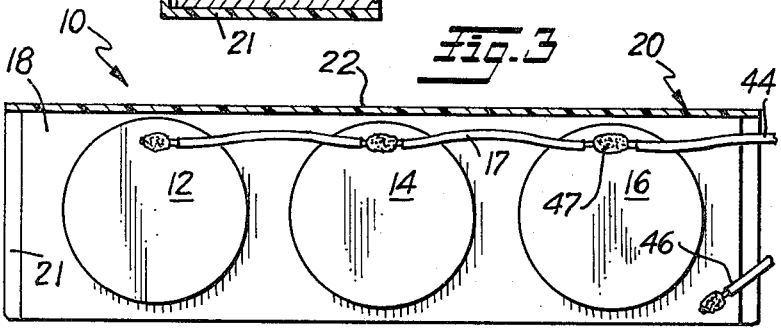
FIG. 3 is an enlarged elongated sectional view taken on the line 3—3 of FIG. 1.

In the format of the solar cell power package 10 of FIGS. 1, 2 and 3 the horizontal support means for solar cells 12, 14 and 16 is provided by an elongated rectangular plate 18. There projects a vertical leg portion 22 serving as the spacing means from the horizontal leg portion 21 and this vertical leg portion provides the surface onto which a magnetic tape 24 is adhesively secured, e.g., glued. The magnetic tape 24 is used to provide the sole holding attachment which exists as a magnetic attractive force along the entire surface of the vertical leg portion provided with said tape. The magnetic tape is supplied by many rubber manufacturing firms such as Goodyear Tire and Rubber Company, Goodrich Tire and Rubber Company and other rubber companies in the adhesive field. Such tapes generally comprise permanently magnetic powders milled into a matrix of butadiene rubber or copolymer rubber and these tapes are furnished with adhesive layers to facilitate adhesion to the vertical leg portion.

As shown in FIGS. 1, 2 and 3, the preferred embodiment of the invention represented by the reference numeral 10, the singular support means 20 comprises an elongated lightweight rigid heat-resistant plastic, such as LEXAN, a trademark which is owned by General Electric Company, and describes a polycarbonate resin or the plastic ABS, which is a heat-resistant copolymer of acrylonitrile, butadiene and styrene which is reinforced with filler and colored with pigment.

The fluroescent tube 30 as shown in FIG. 1 in electrical connection is provided by the conventional fixture comprising a U-shaped housing 26 in which there is mounted a ballast 28 at an end of the housing and the tube 30 is fitted at the pair of pins 31 and 32 at each end thereof into the corresponding sockets 34 and 36, respectively. The wiring for the conventional flourescent fixture is fitted into the space between the top wall 38 of the housing and the side wall 40.

In the particular use which is illustrative of one of many uses in FIGS. 1–3, the conductors 44 and 46 from the solar cell power package 10 are connected to the dc motor 48 and gear reducer 49 and the shaft 50 from the gear reducer serves to rotate a sign 52. In this embodiment the conductors which supply dc current from solar cells 12, 14 and 16 connected in series in the solar cell power package 10 may be fished through the grille panel 54 if this is desired but this need not be done. This is a simple advantage of the solar cell power package 10 of the invention which cannot be achieved in attachments which have been proposed in displays offered for sale which are constructed to mount the dc motor and rear reducer directly on the tube.

The use of the solar cell package of FIG. 1 is for a sign which rotates slowly as shown in FIG. 1, but other uses are contemplated. For example, the conductor wires may be fished through the grill at the bottom of the conventional fluorescent tube fixture and go directly to the floor to energize an electric train set in which a dc motor provides the motive power for each car of the set and the trackway and transformer serve to adjust the voltage if necessary to control the speed.

Other toys may be connected on the floor in a similar manner. A robot toy containing a dc motor may be connected to a length of wire which permits limited movement of the robot. Such robot toys are known and have been used heretofore with batteries.

Still another example of the use of the solar cell power package of the invention is for a security system. The conductor wires can lead to a doorway and a photoelectric cell system comprising a light beam which can be energized from the fluorescent tube and an alarm also energized from the solar cell power package. When an intruder breaks the light beam, the alarm will sound.

Still another example is a photographic camera which can be energized from the solar cell power package and take a picture of an intruder.

Still another example is a magnetic tape device for recording sounds and incidents which can be coupled with a photoelectric cell and can serve as a surveillance device.

Although numerous examples of a plurality of solar cells in series in which two, three and seven cells form the array of solar cells in the power package are illustrated any of these may have their efficiency increased by using the teaching of Mauer, et al., U.S. Pat. No. 4,149,902.

The elongated horizontal thermoplastic rigid supports 21 and 62 are long enough to accommodate two or three solar cells, and are thus sized to be lightweight. Each cell is connected to the other by conductors 44 (FIG. 1), 74, 75 (FIG. 4) or 87, 88 (FIG. 7). A ground is provided at the edge of the horizontal support layer. At each end of the support, there is provided spacing means in the form of an end panel made of the same material as the base which has an arcuate opening. This spacing means in FIG. 1 cooperates with the magnetic tape which is secured to the angular leg 22 in FIG. 1 and permits the attachment of the support in predetermined spaced relation at a distance predetermined by the height of the spacing means and the housing so that the attachment may be secured by the magnetic tape to the inner metal surface of the housing at the edge of a fluorescent tube which clings to the tape as shown in FIG. 1.

In the mechanical embodiment of solar cell power package 60 in FIGS. 4 and 5, the number of solar cells is 2, the power package 60 comprises a bottom tray support 62, an intermediate tray 61 over the support, side wall 63, end wall 64 and a central slot portion between the intermediate tray 61 and the bottom wall, e.g., slots 65 and 66. The two solar cells in array 68 are connected in series by conductor wires 74 and 75. Stops 67 provide spacing elements to permit a predetermined closeness for the solar cell power package 60 to the bottom of the fluorescent tube 30 by the adjustment of the adjustable strap 70 in the slots.

In contrast to the magnetic holding means which is provided in FIG. 1, the solar cell power package 60 of the embodiment of FIG. 4 uses an adjustable strap 70 which is formed of a flexible plastic. The strap has a length which is sufficient to encircle the tube but is thin and flexible enough to be positioned in between the top of the tube and the holding fixture. The end of the strap is serrated with teeth which fit into the slots and thereby secure the solar cell array in proximity below the bottom of the tube 30.

In FIG. 7 the number of solar cells is 7 which is representative of a number between 5 and 10. The cells shown in FIG. 4 constitute a smaller total area of active solar cell circuits in comparison with either FIG. 1 or FIG. 7.

When there is a need to intensify the current output in a fixed number of cells intensification can be made by adding a light intensifier for the wave length of light emitted from the fluorescent tube. This is accomplished by adding an ultraviolet absorber in a film which is adhered to the surface of the solar cell. A fluorescent concentrator consisting of a fluorescent dye filter material is used to improve the efficiency and thereby to reduce the cost. These filters are identified in FIGS. 4–6 by reference numeral 69 and are described at column 4 of the Mauer, et al. U.S. Pat. No. 4,149,902. An example of such a filter is found in this Mauer, et al. patent which describes a film which improves the electrical efficiency of a solar cell which is illuminated as fluorescent light as from a fluorescent tube. The three dyes mentioned in this patent are Rhodamine B, Coumarin and Fluorescein. Any one of these can be used.

The embodiments which are shown in the power package 10 (FIG. 1), 60 (FIG. 4) and 80 (FIG. 7) weigh only 3-½ to 4 ounces except for the weight of the conductors. This is in contrast to the weight of a dc motor and gear reducer box which alone weigh about 8 ounces. Thus, the advantage of lightness is achieved by the invention at no loss of efficiency.

I claim:

1. A light fixture including a lightweight attachment positioning a solar cell array next to a fluorescent tube, comprising:

a ferromagnetic housing holding a fluorescent tube and a ballast;

a lightweight thermoplastic horizontal support;

a plurality of solar cells in side by side array on said support which are connected to each other in series by a pair of conductors, one of which is connected to a ground on said support;

a holding means structurally connected to said support and fastened to said housing to hold said array of solar cells on said support close to the tube and in fixed relation to the fixture in which said tube is placed:

spacing means which space said support in adjacent spacing to said fluorescent tube; whereby said conductors connecting said plurality of solar cells in series provide a dc current which is due to the radiation impinging upon said array from said fluorescent tube to constitute a power package furnishing dc current as long as said tube is lit.

2. A light fixture as claimed in claim 1 wherein said spacing means is a vertical leg member and said support is a horizontal rectangular elongated support member slightly longer than the horizontal extent of said plurality of solar cells, said vertical leg being secured to said horizontal support at an edge to form an L-shaped unitary combined horizontal support means and vertical spacing means and wherein said holding means comprises a tape containing powdered magnetic elements in a rubber binder, said tape being attached to the outer side of said vertical leg member by mechanical and adhesive means, the side of said vertical leg being such that it permits said tape to be magnetically held by the inner portion of the housing of the fluorescent tube fixture.

3. A light fixture in claim 2 wherein each of said plurality of solar cells comprises a plastic covering containing an ultraviolet absorber concentrating the light energy from said fluorescent tube onto said cell.

4. A light fixture as claimed in claim 1 wherein said horizontal support is provided with a recess at one side and said holding means is a strap, one end of which is secured to one side of said support, the top of which encircles said fluorescent tube and said support and the end of which engages said recess in the other side of said support to mechanically hold said strap in said recess with the strap end being movable into the recess to tighten the strap.

5. A light fixture in claim 1 wherein said plurality of solar cells is at least two.

6. A light fixture in claim 1 wherein said plurality of solar cells is at least three.

7. A light fixture in claim 1 wherein said plurality of solar cells is at least from five to ten.

* * * * *